US006715647B1

(12) United States Patent
Ivins

(10) Patent No.: US 6,715,647 B1
(45) Date of Patent: Apr. 6, 2004

(54) FUNNEL WITH SUPPORT ASSEMBLY

(76) Inventor: Todd Ivins, 1227 Clara Ave., Joliet, IL (US) 60435

( * ) Notice: Subject to any disclaimer, the term of this patent is extended or adjusted under 35 U.S.C. 154(b) by 0 days.

(21) Appl. No.: 10/304,039

(22) Filed: Nov. 25, 2002

(51) Int. Cl.[7] ..... B67B 7/00

(52) U.S. Cl. ..... 222/166; 222/144; 222/460; 222/562; 222/570; 222/160; 141/319; 141/332; 141/333; 141/340; 141/364; 248/130; 248/133; 248/141

(58) Field of Search ..... 222/160, 164, 222/166, 167, 169, 171, 172, 144, 460, 462, 562, 566, 567, 570; 141/2, 18, 21, 319, 320, 331–334, 339–343, 364, 375; 248/130, 133, 139–142

(56) References Cited

U.S. PATENT DOCUMENTS 2,133,474 A * 10/1938 Roscoe ..... 141/364
2,669,736 A 2/1954 Wabnitz ..... 15/121.2
2,872,058 A * 2/1959 Doepke et al. ..... 414/421
3,141,577 A * 7/1964 Watson ..... 222/166
3,155,284 A * 11/1964 Forman et al. ..... 222/144
3,750,722 A 8/1973 Nowak ..... 141/332
4,585,148 A * 4/1986 Ito ..... 222/77
5,477,873 A 12/1995 Ramsey et al. ..... 134/155
6,264,072 B1 * 7/2001 Johannes ..... 222/460
6,431,415 B1 * 8/2002 Schreiber ..... 222/460
6,474,516 B2 * 11/2002 Boers ..... 222/559
6,575,337 B1 * 6/2003 Malavear ..... 222/166

* cited by examiner

*Primary Examiner*—J. Casimer Jacyna
(74) *Attorney, Agent, or Firm*—Goldstein Law Offices, P.C.

(57) ABSTRACT

A funnel with support assembly for pouring paint from a can, having a funnel and a funnel support having a holster and a stand upon which the holster is supported. The funnel may be supported upon the funnel support. The funnel has a large opening located in proximity to the funnel top, a small opening located in proximity to the funnel bottom, and a cap for sealing its small opening. In use, the holster and stand are positioned above a paint tray. The user seals the small opening of the funnel with the cap and attaches the large opening of the funnel to the top of an open can of paint. The can of paint and the attached funnel are then inverted and positioned within the holster. The user begins the flow of paint by removing the cap from the funnel.

7 Claims, 4 Drawing Sheets

FUNNEL WITH SUPPORT ASSEMBLY

BACKGROUND OF THE INVENTION

1. Field of the Invention

The invention relates to a funnel with support assembly which may be used for pouring paint from a paint container.

2. Description of the Related Art

During the process of painting a surface, a user often must replenish a supply of paint by pouring paint directly from an open paint can into a paint tray. However, while pouring paint, a user may inadvertently drip paint onto the sides of the paint can and/or onto the floor upon which the paint tray is located. Consequently, a user would benefit by using a funnel to direct a stream of paint into the tray. Additionally, a user would benefit by using a funnel which may be supported upon a stand while paint is being poured.

U.S. Pat. No. 2,669,736 to Wabnitz appears to show a device for applying paint to a roller applicator. However, Wabnitz is aimed at providing a tray which allows for rapid application of paint to a roller-type applicator. Accordingly, Wabnitz is useless for dispensing paint into a conventional paint tray.

U.S. Pat. No. 3,750,722 to Nowak appears to show a funnel adapted to fit around the top of a can in a liquid tight manner for improved pouring. However, Nowak provides a funnel which must be held by a user while liquid is being poured.

While these units may be suitable for the particular purpose employed, or for general use, they would not be as suitable for the purposes of the present invention as disclosed hereafter.

SUMMARY OF THE INVENTION

It is an object of the invention to produce a funnel which may be easily used with an existing can of paint. Accordingly, the funnel has a large opening which is sized to fit around the periphery of the can, and the funnel may thereby be selectively attached to the can.

It is an additional object of the invention to produce a funnel which may be left attached to a can of paint in between successive uses. Accordingly, the funnel has a cap which is used to selectively seal the small opening of the funnel, thereby eliminating the need to remove the funnel from the can after each use.

It is another object of the invention to produce a funnel which minimizes the possibility of the paint drying within the can. Accordingly, the funnel has a cap which fits tightly over its small opening, thereby minimizing evaporation which would cause the paint to dry within the can.

It is yet another object of the invention to produce a funnel which may be used without being held by the user. Accordingly, the funnel is selectively supported on a funnel support assembly, thereby making it unnecessary for the user to hold the funnel while it is being used.

It is yet still another object of the invention to produce a funnel which may be used to pour a continuous stream of paint. Accordingly, the funnel has a vent tube which extends fully from its large opening to its small opening, thereby allowing for a smooth and continuous flow of paint.

It is still another object of the invention to produce a funnel which may be used in residential and commercial, as well as industrial settings. Accordingly, the funnel does not require complicated instructions, and may be easily used in residential and commercial settings.

The invention is a funnel with support assembly for pouring paint from a can, having a funnel and a funnel support having a holster and a stand upon which the holster is supported. The funnel may be supported upon the funnel support. The funnel has a large opening located in proximity to the funnel top, a small opening located in proximity to the funnel bottom, and a cap for sealing its small opening. In use, the holster and stand are positioned above a paint tray. The user seals the small opening of the funnel with the cap and attaches the large opening of the funnel to the top of an open can of paint. The can of paint and the attached funnel are then inverted and positioned within the holster. The user begins the flow of paint by removing the cap from the funnel.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 4:
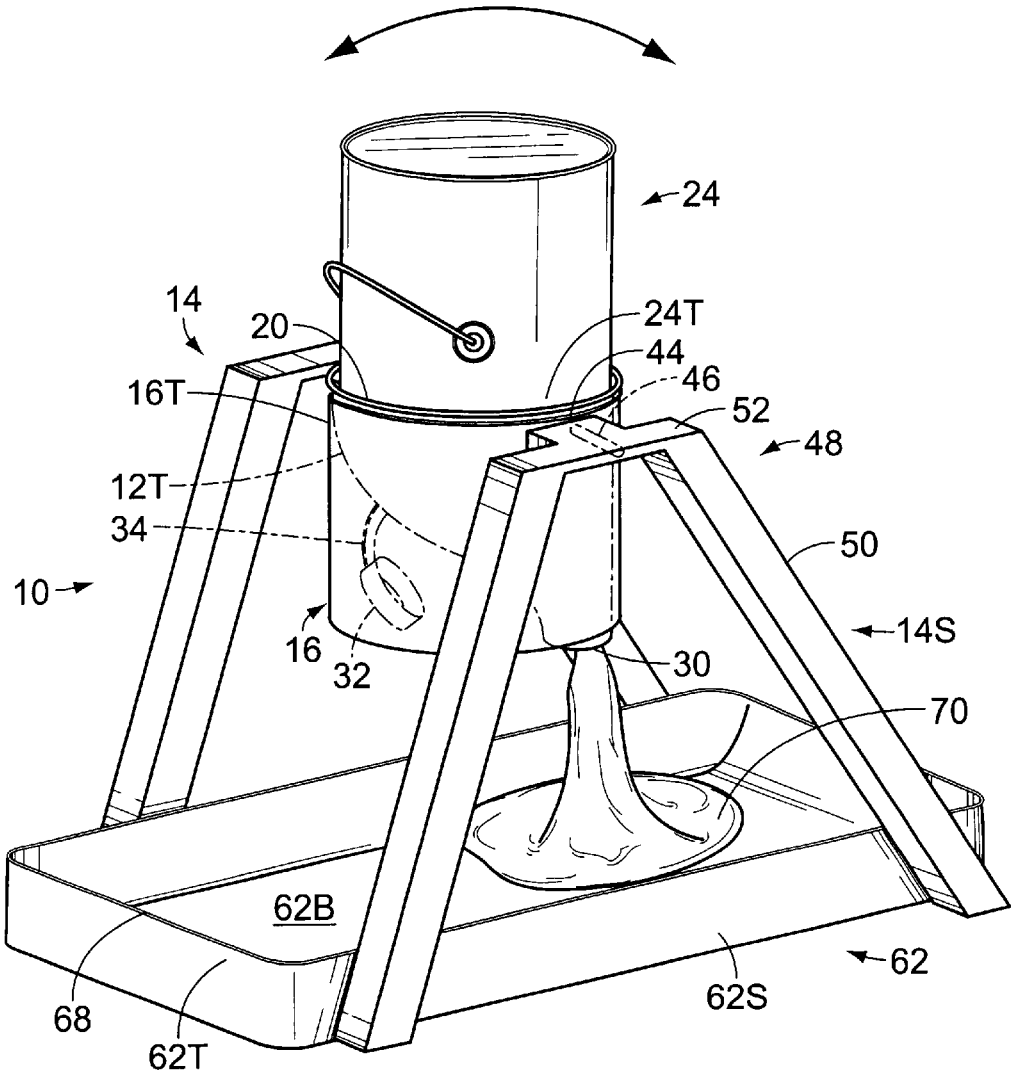
FIG. 4 is a perspective view of the funnel with support assembly while being deployed.

Turning momentarily to FIG. 4, the funnel with support assembly 10 is being used to pour paint 70 from a can of paint 24. The funnel with support assembly 10 comprises a funnel 12 and a funnel support assembly 48 having a holster 16 and a stand 14 upon which the holster 16 is supported.

Figure 1:
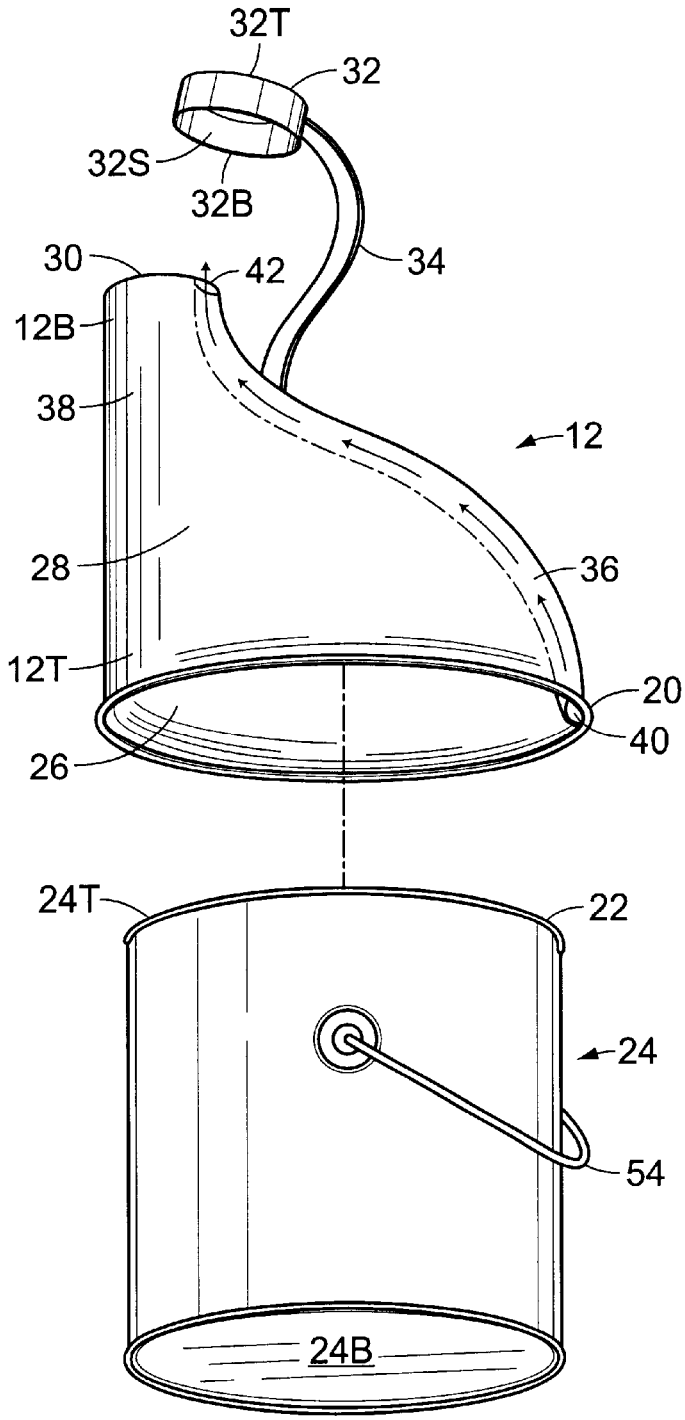
FIG. 1 is a perspective view of the funnel positioned over a can of paint.

FIG. 1 illustrates a perspective view of the funnel 12 positioned over a can of paint 24. The funnel 12 has a hollow main body 28 which is formed from plastic, a funnel top 12T and a funnel bottom 12B, a large opening 26 located in proximity to the funnel top 12T, and a small opening 30 located in proximity to the funnel bottom 12B. The can of paint 24 is substantially cylindrical and has a bottom surface 24B, a top surface 24T, and a handle 54. The can of paint 24 is opened by removing a lid located on its top surface 24T. The top 24T of the can of paint 24 has a peripheral edge 22 which generally has a lip. The large opening 26 of the funnel 12 has an inner diameter which is sized to closely fit around the peripheral edge 22 of the can of paint 24. In particular, the large opening 26 can have a circumferential protuberance which is slightly smaller than the can of paint 24 but which will flex when the top surface 24T of the can of paint 24 is pressed against it, and then flex back to capture the lip. The funnel 12 can thereby be "snapped on" to the can of paint 24. The small opening 30 is offset from the large opening 26 to assist in pouring.

The main body 28 has a neck 38 located closer to the funnel bottom 12B than to the funnel top 12T. The neck 38 is substantially narrower than the portions of the main body 28 which are closer to the funnel top 12T. The funnel 12 has a substantially cylindrical cap 32 which may be used to seal the small opening 30. The cap 32 has a circular side portion 32S and a top portion 32T. When the side portion 32S is pushed over the outer circumference of the small opening 30, the small opening 30 is effectively sealed by the top 32T of the cap 32. The cap 32 has a handle 34 which attaches the cap 32 to the main body 28. The funnel 12 has a protruding rim 20 by which it is supported within its holster 16 when the funnel and support assembly 10 is being deployed as will be described in greater detail hereinafter.

The funnel 12 has a vent tube 36 having an opening 42 located in proximity to the funnel bottom 12B and an opening 40 located in proximity to the funnel top 12T. These openings 40 and 42 allow air to enter the funnel 12 and the attached can of paint 24 while paint is being poured and allow a smooth flow of liquid from the funnel bottom 12B.

Figure 2:
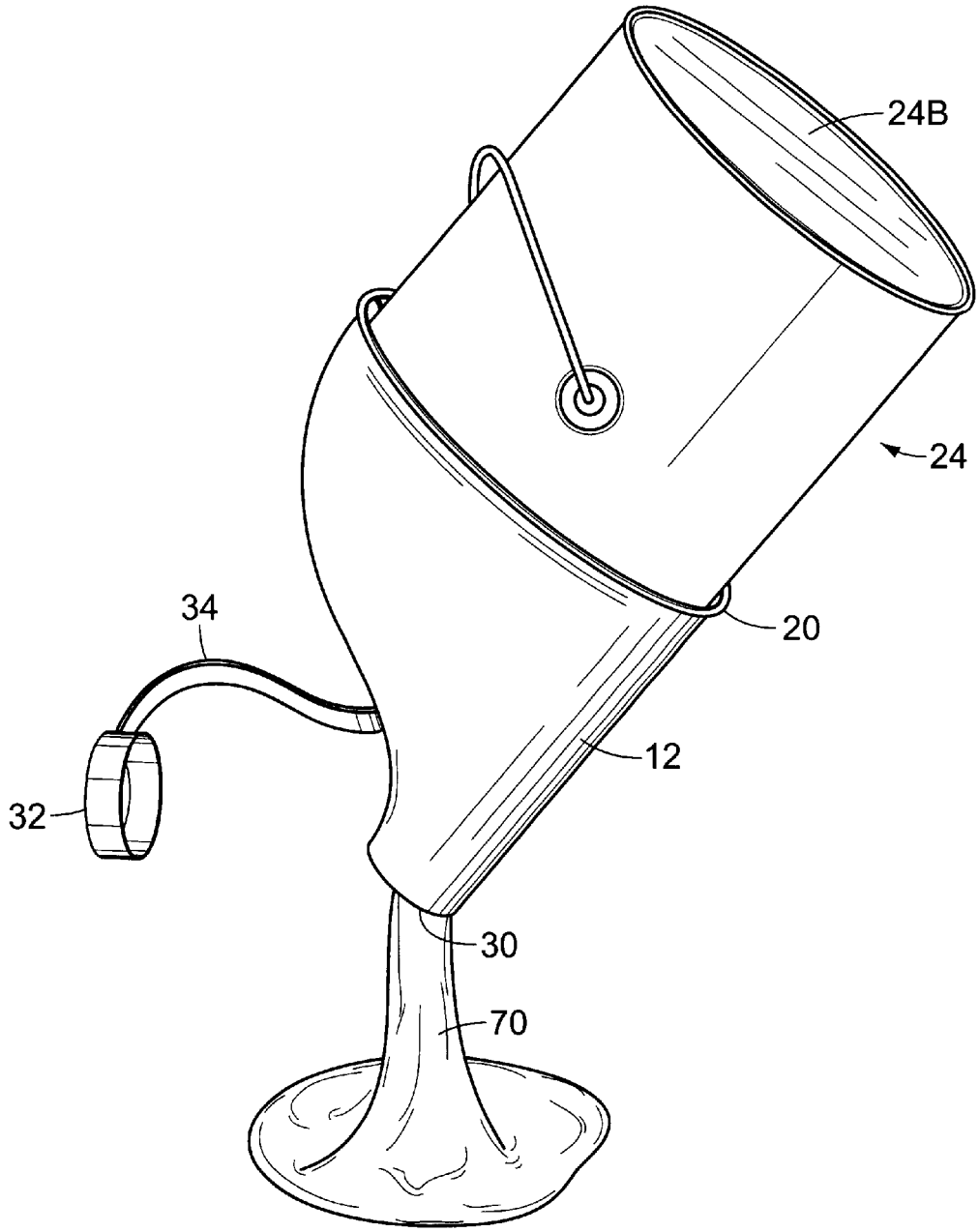
FIG. 2 is a perspective view of the funnel attached to a can of paint. Both have been inverted so that paint may be poured out of the funnel.

FIG. 2 illustrates a perspective view of the funnel 12 attached to the can 24. Both have been inverted so that paint 70 may be poured out of the small opening 30 in the funnel 12.

Figure 3:
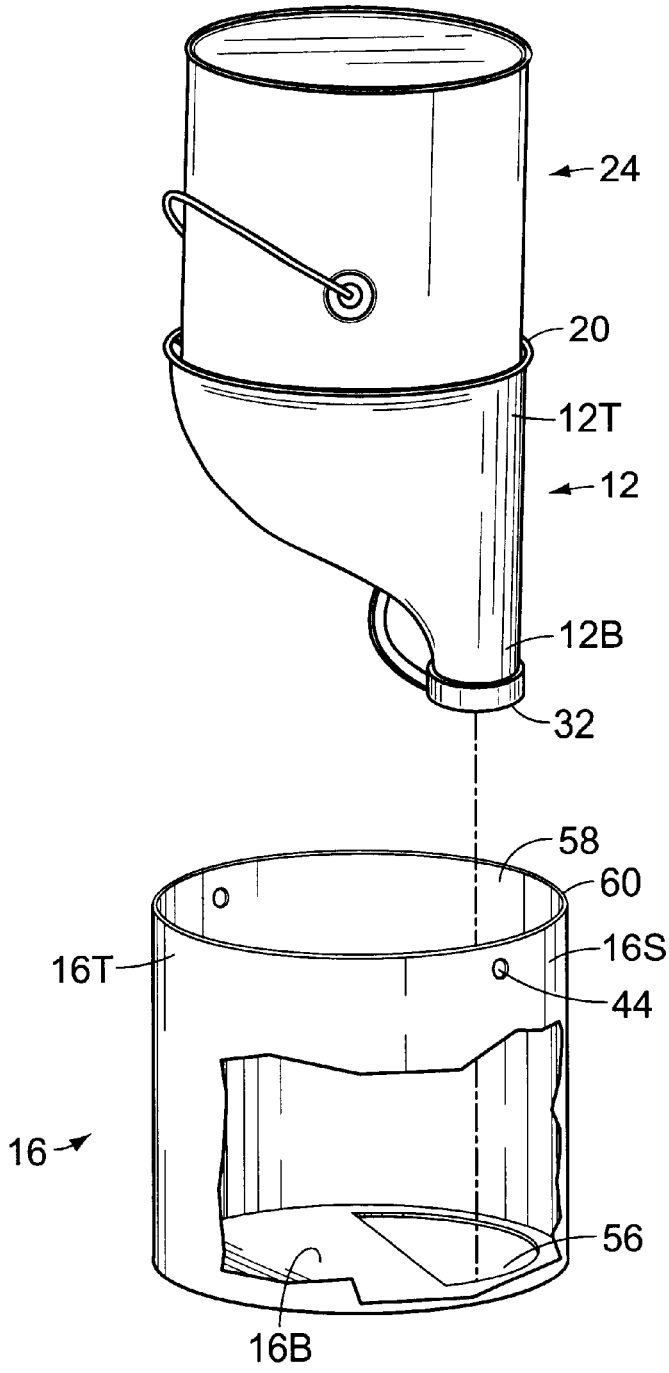
FIG. 3 is a perspective view illustrating how the funnel fits within its holster.

FIG. 3 illustrates how the funnel 12 is fitted within its substantially cylindrical holster 16. The holster 16 has a holster top 16T, a holster bottom 16B, and a side 16S. Portions of the side 16S have been broken away to show the holster bottom 16B. The holster top 16T has a circular top opening 58. To utilize the support assembly 48, the funnel bottom 12B is extended within the top opening 58 of the holster 16 until the protruding rim 20 of the funnel 12 rests upon the holster top 16T. The holster bottom 16B has a hemispherical bottom opening 56 through which paint is poured. The holster 16 has two holes 44 which extend fully through opposite sides of the surface 16S at points which are substantially closer to the holster top 16T than to the holster bottom 16B. The stand 14 has two stand axles 46 which extend through these holes 44, and thereby support the holster 16, as will be described in greater detail hereinafter.

FIG. 4 illustrates a perspective view of the funnel with support assembly 10 positioned over a paint tray 62 being defined by a tray bottom 62B, tray sides 62S, tray top 62T, and an opening 68 located in proximity to the tray top 62T. The funnel 12 is supported within the support assembly 48, which is comprised of the holster 16 and the stand 14. The stand 14 has two sides 14S. Each side 14S has two legs 50, a horizontal member 52 which joins the two legs 50, and a stand axle 46. Each stand axle 46 extends partially from one side 14S toward the other side 14S through one of the holes 44 located on opposite sides 16S of the holster 16, thereby supporting the holster 16 and allowing it to swivel upon the stand axles 46.

An inverted can of paint 24 is attached to the funnel 12 which is supported within its holster 16. Paint 70 flows from the small opening 30 of the funnel 12 into the tray bottom 62B.

In use, the support assembly 48 is positioned by a user over a paint tray 62 such that the two legs 50 on one side 14S of the stand 14 are adjacent to one side 62S of the paint tray 62 and the other two legs 50 on the other side 14S of the stand 14 are adjacent to an opposing side 62S of the paint tray 62. The holster 16 is positioned with its top opening 58 oriented upward.

When the supply of paint within the tray needs to be replenished, the user first removes the lid from the top 24T of a can of paint 24. Then, the user attaches the funnel 12 to the top 24T of the can of paint 24 by "snapping on" the large opening 26 of the funnel 12 to the peripheral edge 22 near the top 24T of the can of paint 24. The user then insures that the small opening 30 of the funnel 12 is covered tightly by the cap 32. Then, the user inverts the can of paint 24 and the attached funnel 12 as indicated in FIG. 3, and inserts it into the top opening 58 of the holster 16. The user may now remove the cap 32 to begin the flow of paint 70 from out of the small opening 30 of the funnel 12. When a sufficient quantity of paint 70 has been funneled into the tray 62, the small opening 30 of the funnel 12 is again sealed with the cap 32.

When additional paint is not needed, the can of paint 24, with the funnel 12 still attached, is removed from the holster 16 and stored in an upright position. The cap 32 prevents paint 70 within the can of paint 24 from evaporating. Alternatively, if prolonged storage is contemplated, the user may snap-off the funnel 12 from the can of paint 24 and cover the can of paint with its own lid. It should be noted that for certain applications, the funnel 12 may be deployed without first positioning it upon the funnel support assembly 48.

In conclusion, herein is presented a funnel with support stand for pouring paint from a can. The invention is illustrated by example in the drawing figures, and throughout the written description. It should be understood that numerous variations are possible, while adhering to the inventive concept. Such variations are contemplated as being a part of the present invention.

What is claimed is:

1. A funnel with support assembly to be used for pouring paint from a can of paint into a paint tray, said can being substantially cylindrical, and having a top surface, a bottom surface, and a peripheral edge surrounding its top surface, comprising:

a funnel having a hollow main body, a funnel top and a funnel bottom, a large opening located in proximity to the funnel top which may be selectively attached to the peripheral edge surrounding the top surface of the can of paint, and a small opening located in proximity to the funnel bottom; and a funnel support assembly having a holster and a stand upon which the holster is supported, wherein said holster comprises a holster top having an opening which is sized to accommodate the funnel, a holster bottom having an opening which allows paint to flow, and wherein said stand has legs which elevate and support the holster above the paint tray.

2. The funnel with support assembly as recited in claim 1, wherein the funnel is attached to the top of the can of paint by snapping the funnel to the top of the can of paint by firmly pushing the large opening of the funnel around the peripheral edge which surrounds the top surface of the can.

3. The funnel with support assembly as recited in claim 2, wherein the small opening of the funnel is offset from the large opening to assist in pouring.

4. The funnel with support assembly as recited in claim 3, wherein the funnel further comprises a vent tube which extends from the large opening to the small opening, wherein the vent tube has an opening located in proximity to the funnel bottom and an opening located in proximity to the funnel top, for allowing air to enter the funnel while liquid is being poured, thereby ensuring a smooth, uninterrupted flow of liquid.

5. The funnel with support assembly as recited in claim 4, wherein the funnel further comprises a cap which is attached to the main body of the funnel, and wherein the cap may be selectively fitted over the small opening of the funnel to seal the funnel bottom.

6. The funnel with support assembly as recited in claim 5, wherein the holster is substantially cylindrical, and has two holes which extend through opposite sides of its surface at points which are substantially closer to the holster top then to the holster bottom, and wherein the stand has two sides wherein each side has a substantially horizontal stand axle extending partially toward the other side, whereby the holster is supported by and may be swiveled upon the stand by extension of one stand axle through one hole and extension of the other stand axle through the other hole.

7. A method of using a funnel with support assembly for pouring paint from a can into a paint tray, said can having a substantially circular top surface having a lid, and a peripheral edge surrounding its top surface, comprising a funnel, a stand, and a holster which is supported by the stand, said funnel having a funnel top having a large opening, a funnel bottom having a small opening, a protruding rim which encircles the funnel top, and a cap for sealing the small opening, said large opening being sized to accommodate the outer diameter of the can of paint so that the funnel may be attached thereto, said holster being substantially cylindrical and having a holster top, a holster bottom, opposing sides, and two holes extending fully through opposing sides, wherein the holster top has a top opening for accommodating the outer surface of the funnel, the holster bottom has a bottom opening for allowing paint to be poured from the funnel, two holes extending fully through opposite sides of the surface, wherein said stand has two sides, each side having legs which may be positioned adjacent to a tray of paint and a stand axle which extends partially from one side toward the other side through one of the holes located on opposite sides of the holster, thereby supporting the holster and allowing it to be swiveled upon the stand axles, and a horizontal member which attaches the legs to each other, comprising the steps of:

a) positioning the funnel support assembly over a paint tray with the top opening of the holster oriented upward;

b) removing the lid from the top surface of a can of paint;

c) placing the large opening of the funnel around the peripheral edge of the top of the can;

d) pushing the funnel onto the top of the can of paint;

e) sealing the small opening of the funnel by pushing the cap onto the funnel bottom;

f) inverting the can of paint and attached funnel so that the funnel bottom extends vertically downward;

g) extending the funnel bottom into the top opening of the holster until the protruding rim of the funnel abuts the holster top, thereby causing the funnel to be supported within its holster;

h) removing the cap from the funnel bottom;

i) allowing paint to flow out from the funnel bottom until the paint tray has been sufficiently filled with paint;

j) replacing the cap on the funnel bottom;

k) removing the can of paint and funnel from the holster; and l) storing the can of paint and attached funnel with the top surface of the can of paint oriented vertically upward.

* * * * *